US005082997A

United States Patent [19]

Vialy

[11] Patent Number: 5,082,997

[45] Date of Patent: Jan. 21, 1992

[54] QUICK-BREAK MINIATURE SWITCH

[76] Inventor: Roger Vialy, Impasse Desbrun, 26120 Chabeuil, France

[21] Appl. No.: 294,572

[22] PCT Filed: Apr. 14, 1987

[86] PCT No.: PCT/FR87/00122

§ 371 Date: Oct. 14, 1988

§ 102(e) Date: Oct. 14, 1988

[87] PCT Pub. No.: WO87/06388

PCT Pub. Date: Oct. 22, 1987

[30] Foreign Application Priority Data

Apr. 16, 1986 [FR] France ..... 86 05673

[51] Int. Cl.[5] ..... H01H 5/18; H01H 5/06

[52] U.S. Cl. ..... 200/452; 200/453; 200/461; 200/456; 200/460

[58] Field of Search ..... 200/409, 408, 453, 445, 200/452, 454, 461, 341, 332, 451, 456, 459

[56] References Cited

U.S. PATENT DOCUMENTS

| | | | |
|---|---|---|---|
| 2,525,044 | 10/1950 | Puerner | 200/456 |
| 2,659,238 | 11/1953 | Martin | 200/409 |
| 2,743,331 | 4/1956 | Lauder et al. | 200/461 |
| 2,825,779 | 3/1958 | Kelleigh | 200/445 |
| 3,030,466 | 4/1962 | Kryder | 200/453 |
| 3,336,449 | 8/1967 | Ashman | 200/452 |
| 3,532,840 | 10/1970 | Bauer | 200/452 |
| 3,548,132 | 12/1970 | Kreiger | 200/452 |
| 3,809,837 | 5/1974 | Yoshioka | 200/332 |
| 3,838,237 | 9/1974 | Hoishioka | 200/452 |
| 4,072,841 | 2/1978 | Corfield | 200/408 |
| 4,499,346 | 2/1985 | Portmann | 200/452 |
| 4,673,778 | 6/1987 | Lewandowski et al. | 200/332 |
| 4,891,481 | 1/1990 | Comerford | 200/452 |

FOREIGN PATENT DOCUMENTS

| | | | |
|---|---|---|---|
| 1189971 | 4/1970 | United Kingdom | 200/409 |

*Primary Examiner*—Henry J. Recla
*Assistant Examiner*—Keith Kupferschmid
*Attorney, Agent, or Firm*—Rosenman & Colin

[57] ABSTRACT

Switch of the tilting blade type wherein the spring blade (35) provides for the tension of the moving blade (38) and the return of the pusher (39); under the action of the pusher(39) the spring blade (35) separates progressively from the inclined terminal (34); the inclination value is given for products in compliance with standard (DIN 41635, shape A); the closure system of the case comprises flanges which retain the cover; the shaft of the accessories is cast in a single operation.

5 Claims, 2 Drawing Sheets

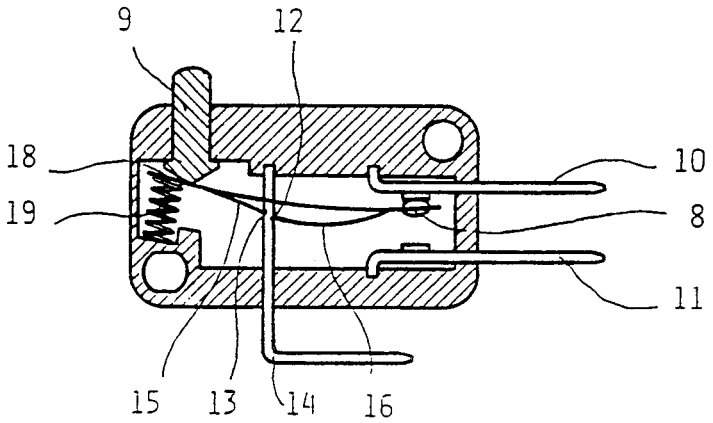
FIG. 1
PRIOR ART
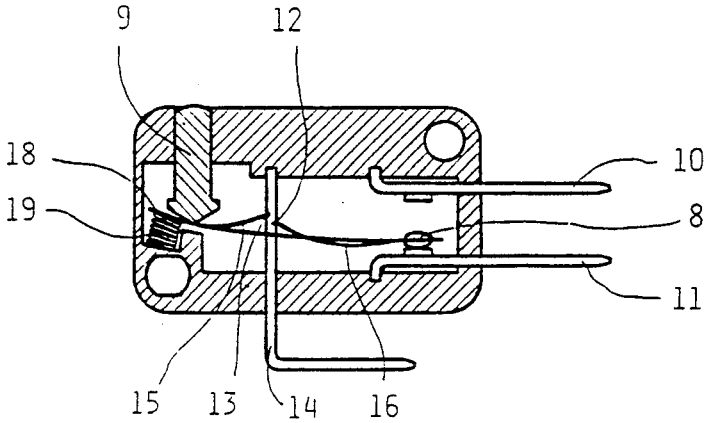
FIG. 2
PRIOR ART
FIG. 3
PRIOR ART
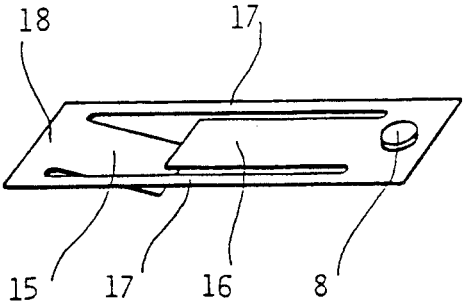
FIG. 4
PRIOR ART
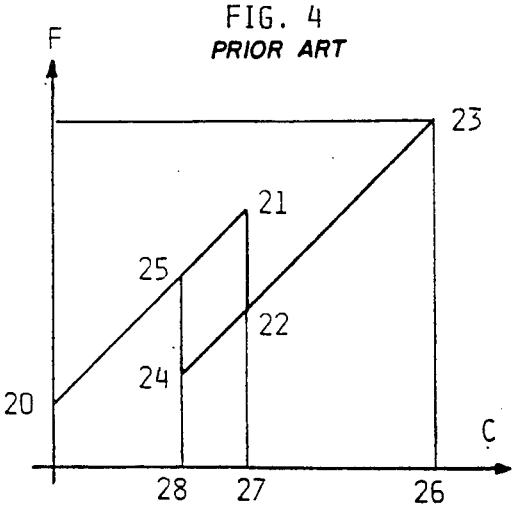

QUICK-BREAK MINIATURE SWITCH

BACKGRUND OF THE INVENTION

1. Field of the Invention

The present invention relates to miniature quick-break switches. They comprise, inside a moulded plastic material case, a rocking blade mechanism actuated by an external push-button, this blade, pivoting on a common terminal, ensures the electric continuity alternately between the common terminal and two separate terminals.

2. Description of the Prior Art

The operating principles of such apparatus are well known and described in numerous patents. The following French patents may be cited by way of example: 1 182 508, 2 072 376, 2 472 827 and 2 531 262.

Their use as components of automatic devices must satisfy the approval conditions of international standards, and in particular: interchangeability, electric insulation, reliability, absence of balance point, low operating force, high cut-off power.

Since the development of the market has led to fierce competition, manufactures have been led to design products at the lowest cost price. For that, these products must comprise a minimum number of parts whose shapes must be compatible with automated manufacturing, assembly and control equipment.

One of the mechanisms among the most simple is described in the French patent 1 182 508 applied for on Sept. 30, 1957. Its priciple, which has served as the basis for several types of product, manufactured at the present time in very large numbers, shown in FIGS. 1–4.

This prior art device comprises a resilient mobile blade 18, FIG. 3, hinged in notches 12, 13 formed on each side in the common terminal 14, FIG. 1. The position of these notches and the length of the arms 15 and 16 of blade 18 define a resilient deformation of these arms, thus creating reaction forces on terminal 10. A spring 19, placed under blade 18, opposes the movement of the push-button 9; FIG. 2 shows that movement of the push-button downwards causes the mobile contact 8 to pass quickly from terminal 10 to 11, when the arms 17 of blade 18 pass beyond notch 12. The electric continuity is then provided between the common terminal 14 and terminal 11. The contact force of contact 8 is then a resultant of the tension of arms 15 and 16 of the mobile blade.

The action force F on the push-button as a function of its travel C is usually represented by a diagram. FIG. 4 shows the diagram corresponding to the type of switch shown in FIGS. 1–3. The action force on the push-button increases from paint 20 to rocking point 21 of the mobile blade when arms 17 pass beyond notch 12, and the mobile contact 8 passes suddenly from terminal 10 to 11. The action force drops at point 22, for it is reduced by the force necessary for the tension of arm 16. From paint 22 to 23 the action force again increases smoothly, until spring 19 is totally compressed as shown in FIG. 2. In the return movement, the procedure is reversed, from paint 23 to 24 the action force decreases; when arms 17 pass beyond notch 12 the contact 8 passes quickly from terminal 11 to 10. The action force is increased at paint 25 by the tension of arm 16 and then decreases again as far as paint 20. In this graphic representation, the movement from paint 20 to 27 is usually called the approach stroke, from paint 27 to 26 the after stroke and from paint 27 to 28 the differential stroke.

This diagram shows a relatively large increase in the action force, which is not favorable for sensitive switches for which a low operating force is desirable. In addition, any appreciable variation of the control forces results in an increased fatigue of the mechanical members, and so a reduction of the lifespan of the product.

The great variety of industrial applications of this type of product requires a large flexibility of adaptation. Its characteristics will have to be able to vary in large proportions.

OBJECT OF THE INVENTION

The object of the invention is to provide a quick-break switch having a large capacity of adaptation, a relatively constant operating force, a low manufacturing cost, a limited number of parts particularly adapted to automated manufactured and assembly, and good electric, mechanical and reliability performances.

BRIEF DESCRIPTION OF THE DRAWINGS

Several embodiments of the present invention will be given hereafter by way of examples with reference to the accompanying drawings in which:

FIGS. 1 to 4 show the prior art switch while FIGS. 5 to 12 show the switch of the invention.

FIG. 1 is a section of the prior art switch in the top contact position.

FIG. 2 is the section of the prior art switch in the bottom contact position.

FIG. 3 is a perspective view of the quick-break member of FIGS. 1 or 2.

FIG. 4 is the stroke-operating force diagram of the prior art switch of FIGS. 1 and 2.

FIG. 5 is a section of a switch of the invention in the top contact position.

FIG. 6 is the section of the switch of the invention in the bottom contact position.

FIG. 7 is a perspective view of a quick-break member of FIGS. 5 or 6.

FIG. 8 is the stroke-operating force diagram of the switch of FIGS. 5 and 6.

DETAILED DESCRIPTION OF THE PREFERRED EMBODIMENTS

Figure 5:
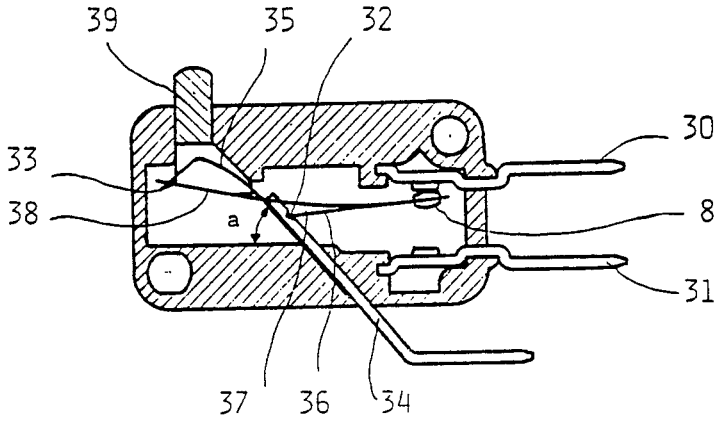
Figure 6:
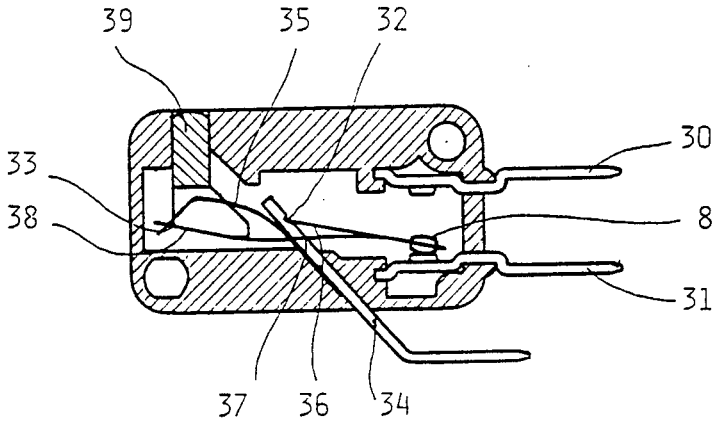
Figure 7:
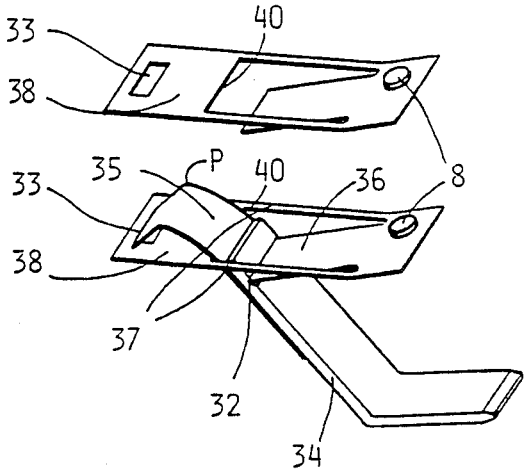

The invention shown in FIGS. 5, 6 and 7, in positions comparable to those of FIGS. 1, 2 and 3 is formed of a mobile blade 38, hinged in the notch 32 of a common inclined terminal 34, by its pivoting portion 36. This blade is held under tension by a blade shaped spring 35, fixed by different known means to the inclined terminal 34, and whose other free shouldered end is engaged in an aperture 33 of the mobile blade 38. This configuration has the feature that the blade spring 35 separates progressively from the inclined terminal 34 as push-button 39 is pressed in. Contact between the blade spring 35 and the inclined terminal 34 varies during rocking of contact 8 to contact 31.

Figure 8:
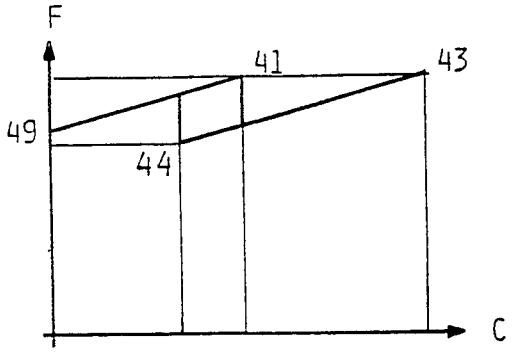

The characteristic property of this blade spring is to provide a relatively constant tension force, for its active length increases at the same time as its flexion. The result is that the operating force on the push-button varies little. This capacity will be better understood from examining the diagram of FIG. 8. The operation takes place in a small force variation range. In fact, the variation of the action force in its end values: minima 49 and 44, maxima 41 and 43, are proportionally lower than in the case shown in FIG. 4.

The shape and the dimensions of the blade spring and of the mobile blade, and their physical characteristics, determine the values of the reaction force on the push-button and of the tractive force on the mobile blade, on which the bearing force on the contacts depends. The slant of the common terminal determines the variation of the operating force. The choice of these characteristics will be made depending on the needs.

The product shown by way of example complies with the International Standard (DIN 41635, form A) and can be applied not only to high current switches with wide separation of the contacts but also to sensitive switches with a low operating force. In this case, the slant of the plane of the common terminal 34, on which the blade spring 35 unwinds, with respect to the mean position of the mobile blade 38 defined by a horizontal of the case, is between 40° and 50°, angle a in FIG. 5. This value is optimum for the application considered. In the other cases, the slant may vary from 35° to 75°, the large angles promoting the constancy of the operating force and conversely.

By its construction, the invention makes possible the use of high intensity currents. The central portion 36 of the mobile blade 38 which is the main current conductor, has no spring function. Consequently, the blade may have a sufficient section and be formed of a metal having good electric conductivity. On the other hand, the blade spring 35 will be forme of a metal having good mechanical characteristics and more particularly that of fatigue resistance, even to the detriment of its electric conductivity, for it is not the main electric current conductor.

The invention provides ease of assembly of the apparatus. The mobile blade 38, the common terminal 34 and the blade spring 35 which is fixed thereto, form an homogeneous one-piece sub-assembly. In fact, in FIG. 7 it can be seen that the blade spring, because of its tension, pulls the mobile blade into notch 32 and holds it in the position shown, against the edge 40 which serves as bearing point for it. The free end of the blade spring 35, engaged up to its shoulders in aperture 33 of the mobile blade 38, forms therewith a flexible hinge. This sub-assembly may be readily fitted into the case of the switch manually or using automatic means. Subsequent assembly of fixed contact 30 and push-button 39 frees the mobile blade from its bearing point 40 and thus sets it, so as to provide the necessary contact force. This sub-assembly system makes possible self-centering of the mobile blade on the common terminal by the tension of the blade spring. Thus, the width of the mobile blade may be maximum, which is favorable for the mechanical and electrical characteristics of the product.

Construction of the invention raises no special problem for the industry specialized in the manufacture of this type of product. The blade spring 35 will have to be assembled on the common terminal 34 so that: the two parts are well aligned, the blade spring may freely separate from the common terminal and the electric connection between the two parts must be perfect. It is recommended to bend the end of the blade spring at about 45°, bend P in FIG. 7, so as to facilitate introduction of the blade spring into the aperture 33.

The invention, the drawings of which are appropriate to an industrial embodiment, is applied preferably to products conforming to the international standard (DIN 41635, form A) and equivalent.

What is claimed is:

1. A snap-action electrical switch, comprising:

a housing having an interior;

a pair of fixed terminals, each having stationary electrical contacts mounted within the interior of the housing;

a common terminal having an inner end mounted within the interior of the housing and having opposite, generally planar, terminal surfaces;

a one-piece, movable switching element having a mobile electrical contact and mounted for movement between switching positions in each of which the mobile contact engages one of the stationary contacts, said switching element having an opening through which the inner end of the common terminal extends, a pivot portion pivotably engaged with one of the terminal surfaces of the inner end of the common terminal at one side of the opening, and a resilient blade portion located at the other side of the opening;

an elongated leaf spring having one end fixed to the inner end of the common terminal an opposite end fixed to the blade portion, and a generally planar, spring portion intemediate the ends of the spring and extending through the op ening of the switching element into surface engagement with the other of the terminal surfaces of the inner end of the common terminal to place the switching element under tension; and an actuator mounted for displacement on the housing for moving the switching element between the switching positions, said actuator being in force-transmitting engagement with the blade portion to move the blade portion and, in turn, to progressively break the surface engagement between the generally planar spring portion and the other terminal surface of the inner end of the common terminal.

2. The switch as claimed in claim 1, wherein the blade portion is integrally connected to the pivot portion by outer strips.

3. The switch as claimed in claim 1, wherein the blade portion has an aperture, and wherein said opposite end of the leaf spring is received under tension in the aperture.

4. The switch as claimed in claim 3, wherein said opposite end of the leaf spring is bent and partially overlies the blade portion.

5. The switch as claimed in claim 1, wherein the other terminal surface of the inner end of the common terminal with which the spring portion intermediate the ends of the spring is in surface engagement is a plane surface which is inclined relative to a mean position assumed by the resilient blade portion when the mobile contact is equally distant from the stationary contacts.

* * * * *